United States Patent [19]

Ingwersen

[11] 4,141,557

[45] * Feb. 27, 1979

[54] SIMULATED GOLF GREEN

[76] Inventor: Samuel E. Ingwersen, 529 E. Town St., Columbus, Ohio 43215

[ * ] Notice: The portion of the term of this patent subsequent to Nov. 9, 1993, has been disclaimed.

[21] Appl. No.: 727,361

[22] Filed: Sep. 27, 1976

Related U.S. Application Data

[63] Continuation-in-part of Ser. No. 544,304, Jan. 27, 1975, Pat. No. 3,990,708.

[51] Int. Cl.[2] ..... A63B 69/36

[52] U.S. Cl. ..... 273/181 A; 273/181 F; 273/185 R

[58] Field of Search ..... 273/181 A, 181 D, 176 A, 273/181 F, 185 B, 105 R, 185 R, 184 R

[56] References Cited

U.S. PATENT DOCUMENTS

| | | | |
|---|---|---|---|
| 1,527,988 | 3/1925 | McMurtrie | 273/105 R |
| 3,413,005 | 11/1968 | Stearns | 273/181 A X |
| 3,649,025 | 3/1972 | Garland | 273/176 A |
| 3,826,501 | 7/1974 | Hiromachi | 273/176 A |
| 3,990,708 | 11/1976 | Ingwersen | 273/176 A |

*Primary Examiner*—George J. Marlo
*Attorney, Agent, or Firm*—Van D. Harrison, Jr.

[57] ABSTRACT

Disclosed is a segmented target useful particularly as a simulated golf green. The target is made up of multiple parallel strands of wire supported above the ground and running cross wise to each other, thus defining a number of segmented areas. A netting lies over the wire strands and segmented areas. In each segmented area the netting extends downwardly in a conical shape that terminates in a ring structure fitted with an electrical switch for indicating at a remote location the passage of a golf ball through the ring structure.

2 Claims, 5 Drawing Figures

SIMULATED GOLF GREEN

REFERENCES TO RELATED PATENTS

This is a continuation-in-part of my copending application, Ser. No. 544,304, filed Jan. 27, 1975, now U.S. Pat. No. 3,990,708.

NATURE OF INVENTION

This invention is concerned with targets wherein the point of impact of a projectile striking the target is indicated at a point removed from the target. More particularly it is concerned with simulated golf greens wherein the place where a golf ball lands on the green is indicated at a location removed from the simulated green.

BACKGROUND OF THE INVENTION

In my copending application I disclose an indoor-/outdoor golf recreational facility having a plurality of simulated golf greens. It is necessary that each simulated green be adapted so that when a golf ball lands at a location on the simulated green, that location can be indicated at a register board at a location removed from the green.

An object of this invention therefore is to provide a simulated golf green which will indicate the location of a golf ball landing on the green. Other objects of the invention will be readily apparent from the following disclosure.

SUMMARY OF THE INVENTION

Briefly stated, this invention comprises a segmented target (a simulated golf green) made up of a plurality of contiguous open segment areas, there lying below each open segment area a downwardly tapering enclosure of netting terminating in a ring structure adapted to transfer therethrough a projectile falling in the open segment area and adapted to indicate at a location removed from the target the location of the segment and the passage therethrough of said projectile with reference to a point located in or near the target area.

Although the remainder of this disclosure is directed to the embodiment of my invention wherein the segmented target area is a simulated golf green, it will be readily apparent that the segmented area target will be useful in other sports and activities. Accordingly it is not intended to limit the scope of my invention solely to simulated golf greens.

DETAILED DESCRIPTION OF THE INVENTION

Throughout the specification expressions such as "10*a* xx n" refers to segments of a simulated golf green, "12*a* xx n" and "13*a* xx n" refers to wire strands, and "ST6*a* xx n" refers to simulated sand traps. The segmented target described herein may be made up of any number of "n" segments, wire cross-strands, sand traps, etc. For example, the expression "10*a* xx n" means any number of a to n segmented areas, "12*a* xx n" and "13*a* xx n" means wire strands crossing at right angle directions in the quantity of a to n strands. Similarly "ST6*a* xx n" is a number of sand trap segments in the quantity of a to any number, n. It will be apparent that other similar expressions in this description can be understood in a like manner.

Figure 1:
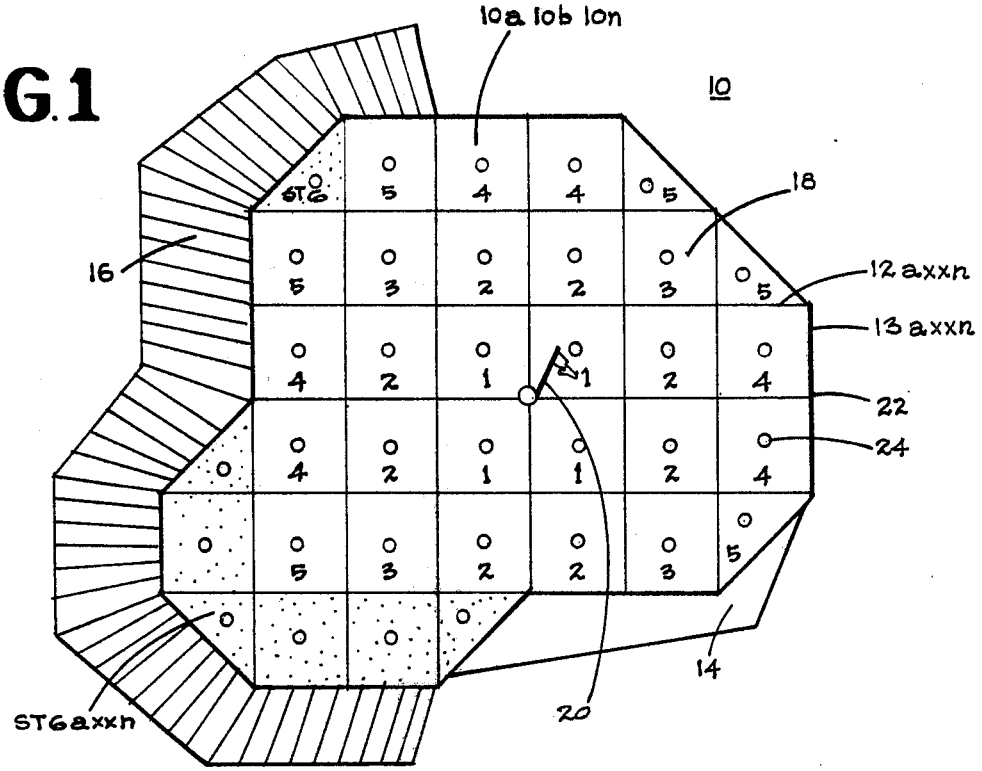
FIG. 1 illustrates a plan view of the simulated golf green in a preferred embodiment.
Figure 2:
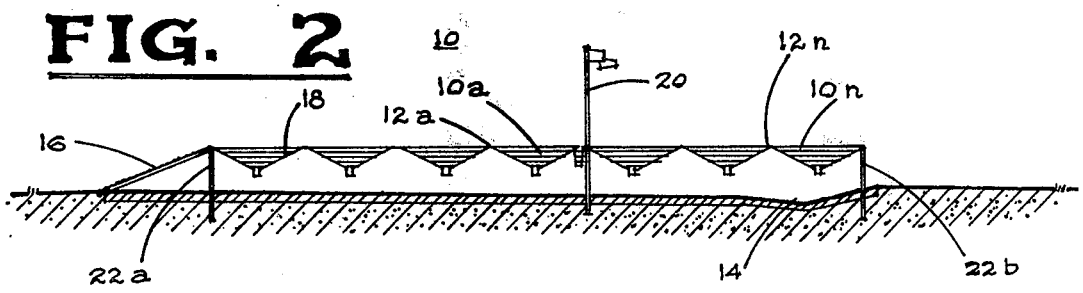
FIG. 2 is a cross sectional view of the simulated golf green of FIG. 1.

The best mode of the invention contemplated and preferred form of the invention is as follows. Referring now to FIGS. 1 and 2, reference numeral 10 generally denotes the areas 10*a* xx n, each segment representative of a given distance from the flagstick 20, or representative of the location of that segment (as is the case of a sandtrap ST6*a* xx n) with reference to the flagstick 20. The green is supported by posts rigidly fixed in the ground at selected spacings, indicated generally at 22 (FIG. 1) and also at reference numerals 22*a* and 22*b* in FIG. 2. A number of cross directional wire strands 12*a* xx n and 13*a* xx n supports a mesh 18 in a segmented configuration. The mesh 18 can be a netting material and preferably is a resilient fabric made of a synthetic fiber, such as nylon, dyed green in the greens area and dyed white in the sand trap area. In each segment the mesh or netting resting therein tapers downwardly, in a conical shape, and terminates in a ringed "hole". This downwardly tapering portion will temporarily retain (or snare) a golf ball landing therein and will (due to gravity) permit the ball to travel on through the ringed area. This area preferably is a rigid ring structure 23 (FIG. 4) attached to the terminus of the conical shaped netting and is fitted with a contact switch 25 wired and electrically connected to a remotely located register board (28). The location of a ball landing on the simulated green and passing through anyone of the segmented areas will be indicated on the register board. The flagstick 20 is more or less a center pole or flag denoting the conventional flagstick for the green. Surrounding most of the front of the green 10 is the apron 16 extending from the edge of green 10 to the ground. This apron is composed of a synthetic turf material to give the appearance of natural grass. Surrounding another portion of the green 10 is a simulated sand trap ST6 comprised of segments ST6*a* xx n.

From a distance, even though the mesh 18 is supported above ground, the apron 16 gives the appearance of a conventional golf green because of the visual effect of the synthetic turf on the apron 16.

At the one end 14 of the green 10 there is a ball retrieval area. Every ball entering any one of the holes 24*a* xx n, for example at 24, in the segments 10*a* xx n is directed to a central collection point 14.

Figure 3:
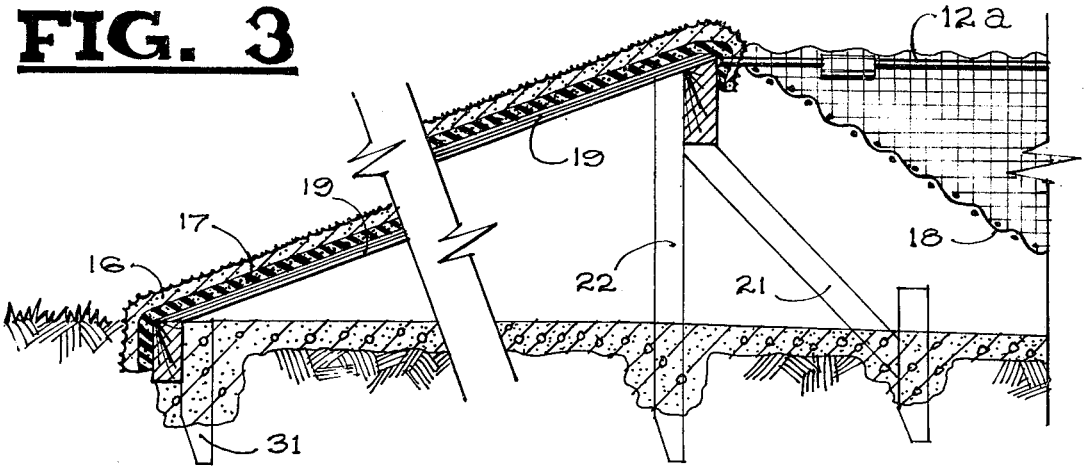
FIG. 3 and FIG. 3A are a series of cross sections of the simulated green of FIG. 2 with certain aspects illustrated in an exploded view. In viewing the drawings FIG. 3A should be viewed as a portion of FIG. 3 continuing to the right of FIG. 3, the top of each figure being on the same horizontal level.
Figure 3A:
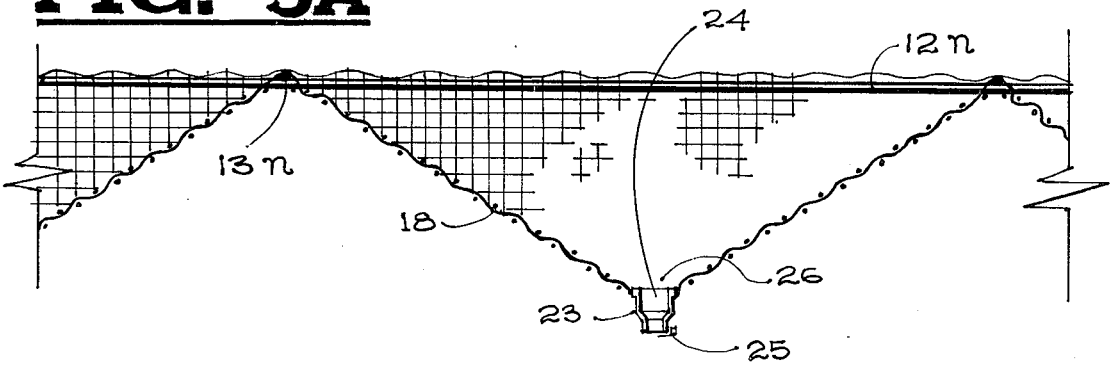

Particular reference is made to FIG. 2, where there is illustrated the green 10 in cross-section and to FIG. 3 wherein certain portions of the cross-sectional view of FIG. 2 is exploded. A pair of posts 22*a* and 22*b* support strands of wire 12*a* xx n in a first direction and a pair of posts 22*c* and 22 *d* (not shown) support the strands of wire 13*a* xx n in a second direction. The posts 22 as shown in FIG. 3 are sunk into the ground with a concrete base. An angle or knee brace 21 also sunk into the concrete provides rigidity.

Suspended from the two-directional posts 22 is a network of supporting strands 12*a* xx n in the one direction and 13*a* xx n in the other direction. The network of strands are such that in cross-section they divide the netting or mesh 18 into segments 10*a* xx n.

Figure 4:
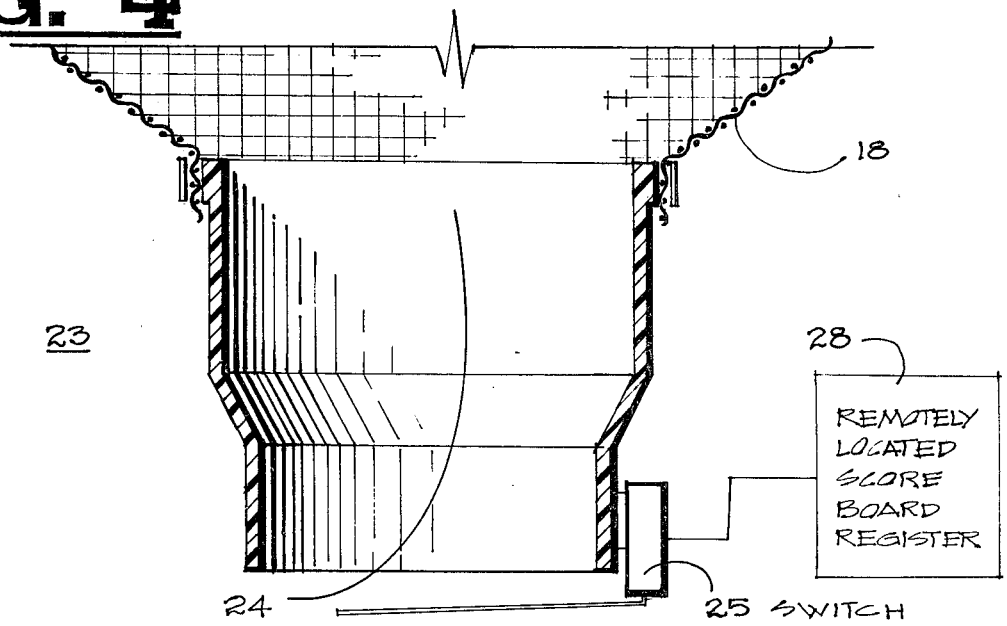
FIG. 4 is a vertical cross section of the ring structure located at the bottom and suspended by netting at the bottom of one of the open segments.

Referring now to FIG. 3 and FIG. 4, in the center of each segment there is a ring structure 23 with circular opening 24. Initially the ring structure 23 provides the necessary weight for the mesh to slope from all directions to the center. The ring structure has a hole region 26 sloping to the bottom portion wherein a switch 25 is mounted. As the ball lands in and hits the mesh 18 it rolls toward the center, into the hole 24 and then drops further to actuate the electrical switch 25 as it passes through to the retrieval trough. The switch 25 when it is depressed by the ball completes an electrical circuit which indicates the appropriate segment area at a remotely located register board 28. As pointed out above, each green has a ball retrieval area, accordingly each simulated green has a trough floor which slopes to a central reception area.

The apron 16 overhangs the uppermost part of the post 22*a* and is tautly supported at its outer perimeter with a belowground stake 31. The apron, in order to provide a soft but rigid structure, is supported on a plywood-type base 19 with an intermediate layer of foam rubber 17.

Referring again to FIG. 1 it is noted that the segments of the green 10 have a like-number notation thereon. In this embodiment the flagstick 20 is approximately centrally located hence the segments that surround the flagstick are of equal distance from the flagstick, and so on to the outer segments. In the configuration of FIG. 1, although 35 segments are shown, there are only seven locations given; a hole in one at the base of 20, 1 to 5 distances from the flagstick 20 and ST6, the sand trap.

It can be appreciated that a ball hitting in a segment having as a location a "hole in one" or 1 through 6 will register at a remote or removed location as a hole in one or a respective distance or as a trapped ball. This is simply accomplished by wiring (not shown) together each switch 25 at the bottom of the hole 24 representing a segment having a like distance or location. The several fixed distances (in this instance 5) are selectively connected to the remote location. Similarly the segment at the base of 20 represents a hole in one and segments ST6*a* xx n represent given areas of a sand trap. A ball hitting one of these segments will register at the remote location as being a hole in one or in a sand trap. Operation of a display device or register board at the removed or remote location is described in my copending application, Ser. No. 544,304, filed Jan. 27, 1975, now U.S. Pat. No. 3,990,708 which is hereby incorporated by reference.

It will also be readily appreciated that each switch 25 located in the bottom of hole 24 in each segment can be wired separately to a remote indicator board so that the exact segment wherein the ball has landed can be indicated.

Although certain and specific embodiments have been shown and described it is understood that modifications and departure may be made without departing from the spirit and scope of the invention.

I claim:

1. A simulated golf green including means for supporting same above ground level, and including a simulated apron, comprising a plurality of contiguous open segment areas defined by a first plurality of horizontal parallel strands of wire intersected by a second plurality of horizontal parallel strands of wire, there lying below each open segment area a downwardly tapering enclosure of netting terminating in a ring structure adapted to transfer a spent projectile therethrough and to indicate at a removed location the passage of said projectile therethrough, each segmented area being indicative of a given distance or location with reference to a flag stick positioned in said simulated golf green.

2. The simulated golf green of claim 1 wherein said simulated golf green including means for supporting same above ground level is supported above ground level so that said apron extends from said simulated golf green to the ground level.

* * * * *